United States Patent [19]

Challine et al.

[11] 4,142,819

[45] Mar. 6, 1979

[54] PLATFORM FOR INSTALLATION AT SEA OR ON A BODY OF WATER

[75] Inventors: André P. A. Challine, Paris; Alain M. E. Marchal, Vincennes; Vincent F. P. Foglia, Aulnay-sous-Bois, all of France

[73] Assignee: Compagnie Generale pour les Developpements Operationnels des Richesses sous-Marines "C.G.Doris", Paris, France

[21] Appl. No.: 856,050

[22] Filed: Nov. 30, 1977

[30] Foreign Application Priority Data

Dec. 3, 1976 [FR] France ..... 76 36507

[51] Int. Cl.[2] ..... E02B 17/02

[52] U.S. Cl. ..... 405/196; 405/200; 405/211; 405/218

[58] Field of Search ..... 61/87, 88, 89, 90, 91, 61/92, 97, 64, 102; 114/65 R

[56] References Cited

U.S. PATENT DOCUMENTS

| | | | |
|---|---|---|---|
| 3,474,749 | 10/1969 | Williamson | 61/91 X |
| 4,060,995 | 12/1977 | Lacroix | 61/92 |

FOREIGN PATENT DOCUMENTS

| | | | |
|---|---|---|---|
| 1104352 | 2/1968 | United Kingdom | 61/92 |
| 1314386 | 4/1973 | United Kingdom | 61/88 |

*Primary Examiner*—Jacob Shapiro

*Attorney, Agent, or Firm*—Laurence R. Brown

[57] ABSTRACT

A gravity platform for supporting installations above a body of water, comprising a base for resting on the bed of the body of water, a structure secured to the base and rising vertically therefrom, a bridge provided with float means, and means enabling the bridge to be displaced along the structure, the base consisting essentially of a slab provided with stiffeners, such as a circular wall and diaphragms, essential for its mechanical strength, the structure forming a hollow column, impervious or not, rising from the middle of the platform, and the float means consisting of an impervious shell formed around the hollow column at the lower part at least of the bridge and forming, possibly with said hollow column, if it is impervious, a float the buoyancy of which is sufficient to support the assembly of the platform and its installations.

8 Claims, 14 Drawing Figures

PLATFORM FOR INSTALLATION AT SEA OR ON A BODY OF WATER

The invention relates to platforms comprising a structure resting upon the bed of a body of water, particularly on the bed of the sea, for supporting, above the surface of the water, industrial or scientific installations, for example petroleum drilling or production rigs. It relates more particularly to a so-called "gravity platform" i.e. resting on the soil under its own weight.

A gravity platform is described in the applicants' British Pat. No. 1,470,893 comprising a heavy base for resting on the bed and provided with impervious compartments which give it a certain buoyancy, a plurality of impervious hollow columns fixed to said base and extending vertically therefrom, a bridge consisting of a float integral with a platform for supporting the installations, means enabling the bridge to be displaced along the columns, and means for progressively flooding the impervious compartment and the hollow columns.

Such a platform is designed to be constructed of concrete. The impervious compartmentalised base and impervious hollow columns, which are essential for a platform intended to be installed at great depths (for example depths of 150 meters or more), considerably increase the weight of concrete and the cost of the platform.

The present invention seeks to provide improvements which will in particular provide an important economy in the weight and cost of a concrete platform or a platform of mixed concrete and steel construction, intended to be installed at moderate depths, for example of the order of 30 to 40 meters.

The platform according to the invention comprises a base consisting essentially of a slab provided with a peripheral circular wall forming therewith a float the buoyancy of which is sufficient to support the assembly of the platform and the installations, a central hollow column, which may or may not be impervious, fixed to said base and extending vertically therefrom, a bridge supporting the installations and of which at least the lower part forms an impervious shell around the hollow column, said shell forming, possibly with said hollow column if it is impervious, a float the buoyancy of which is sufficient to support the assembly of the platform and the installations, and means for displacing the bridge along the hollow column.

The bridge is particularly well adapted to be formed of metallic construction, while the base and the hollow column can easily be made of concrete, which enables a relatively light, and thus cheap, platform to be made, taking advantage of the stability and resistance to stresses and corrosion characteristic of concrete gravity platforms. The concrete parts require practically no maintenance and the metallic bridge can easily be maintained since it is located above the surface of the water when the platform is in use.

The platform according to the invention is advantageously constructed and placed in position by the method consisting of carrying out the complete construction of the platform and the placing in position of the majority at least of the installations, in a dry dock, then launching the platform supported by the base floating on the water, and towing the platform, supported by the shell floating on the water, to the installation site. The means for displacing the bridge are then actuated to allow the base to descend under its own weight to the bed of the sea or other body of water, then for raising the bridge along the hollow column. This method also forms part of the invention.

An important advantage of the method described above is that it is not necessary to have available, adjacent the dry dock, a sheltered berth of appreciable depth in order to carry out afloat the completion of the construction of the platform and the placing in position of the installations, as is the case in previously known methods.

The following description, with reference to the accompanying drawings, given by way of non-limiting example, will enable the method of carrying out the invention to be well understood, all particulars of both the drawings and the text coming, it will be understood, within the scope of the invention.

Figure 8:
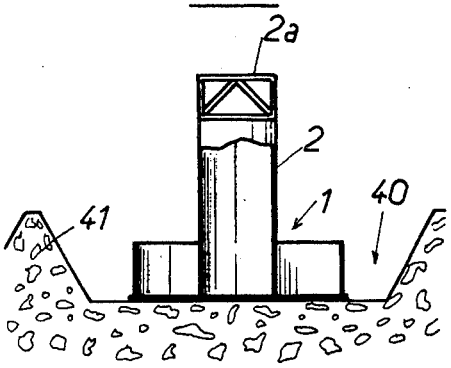
Figure 8A:
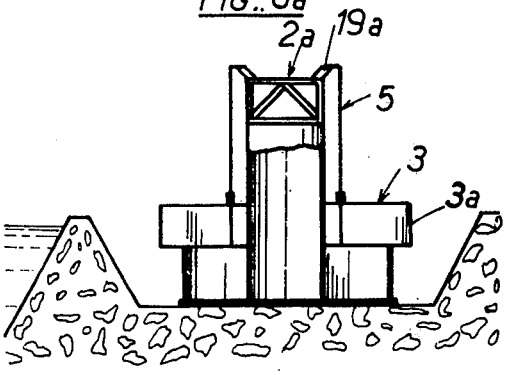
Figure 8B:
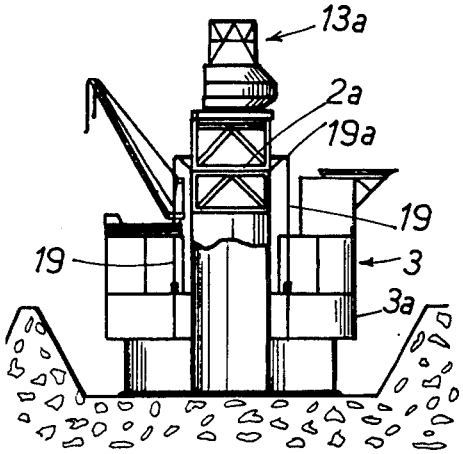
Figure 9:
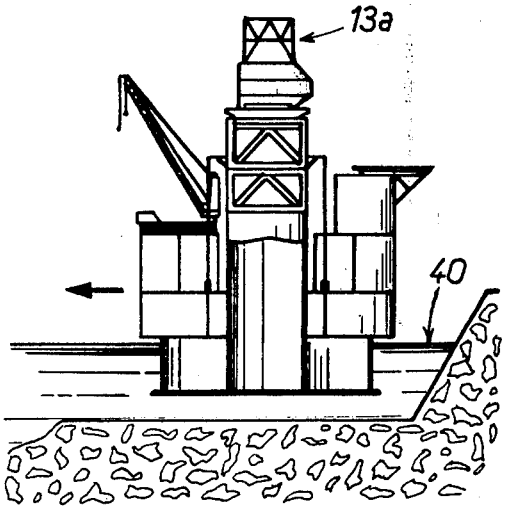
Figure 10:
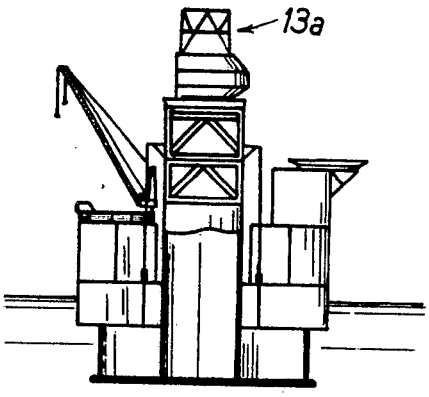
Figure 11:
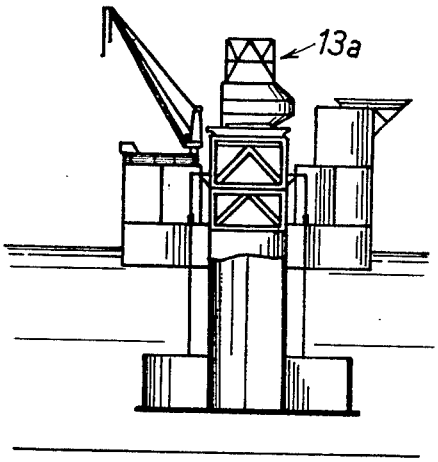
Figure 11A:
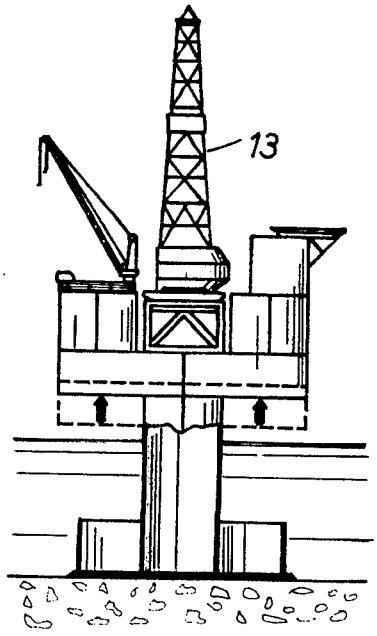

FIGS. 8, 8*a* and 8*b* are views on a reduced scale illustrating the construction of the platform in a dry dock;

FIG. 9 is a view similar to FIG. 8*b*, illustrating the launching;

FIG. 10 is a view similar to FIG. 9, illustrating the towing of the platform;

FIGS. 11 and 11*a* are views similar to FIG. 10, illustrating the placing of the platform in position.

The platform shown is intended to be placed in the sea at a depth of about thirty meters to support, at about ten meters above the surface of the water, a petroleum drilling installation. It comprises a concrete base 1 to which is fixed a central hollow concrete column 2 along which can slide a metallic bridge 3 which supports the installation designated generally by reference 4. The bridge 3 is provided with a metallic shell 3*a* and can be displaced along the column 2 by a lifting device which is shown diagrammatically at 5 in FIGS. 8*a* to 11, and of which the details are shown in FIGS. 3 to 7.

Figure 1:
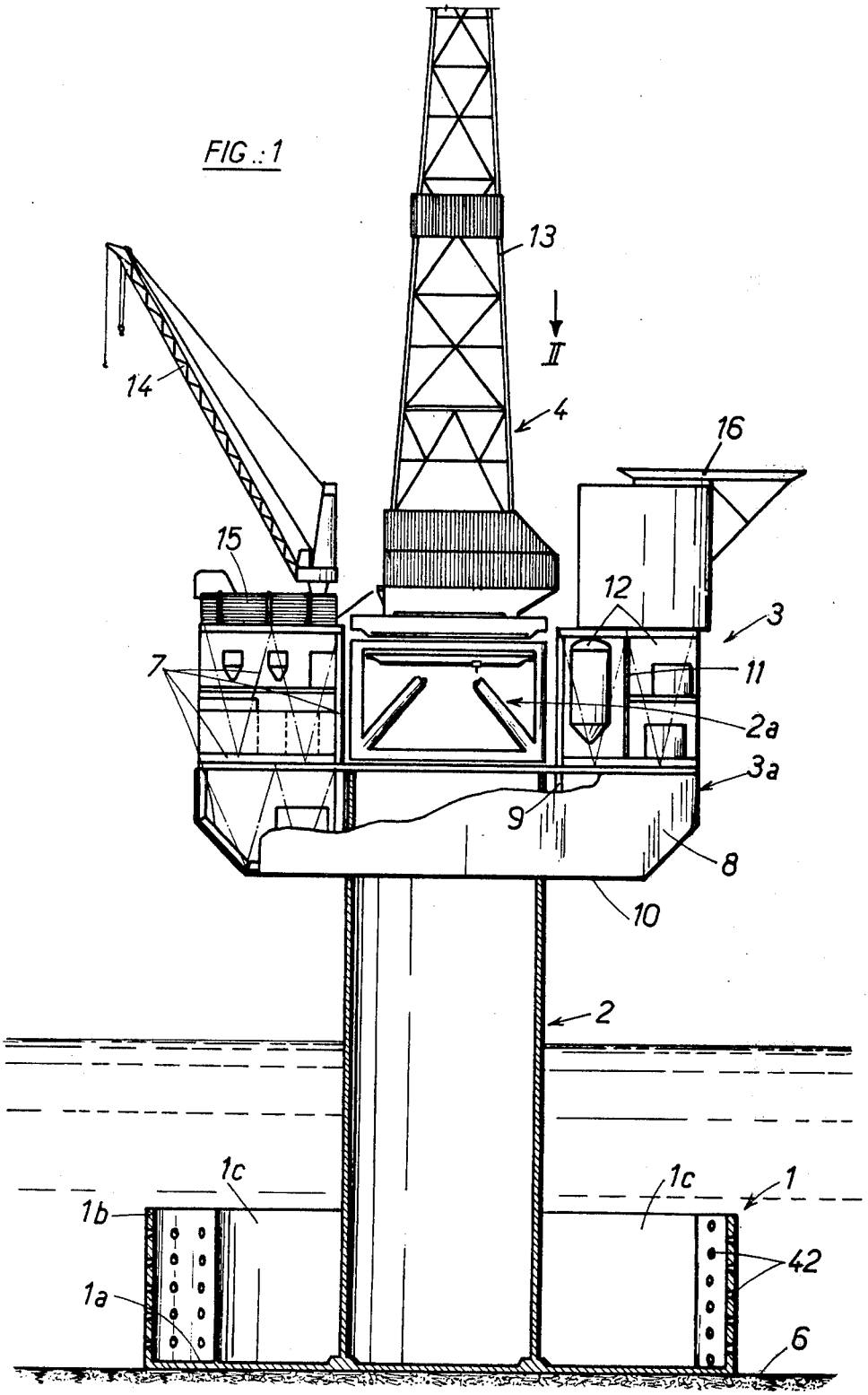
FIG. 1 is an elevation, partly in section, of a platform according to the invention.
Figure 2:
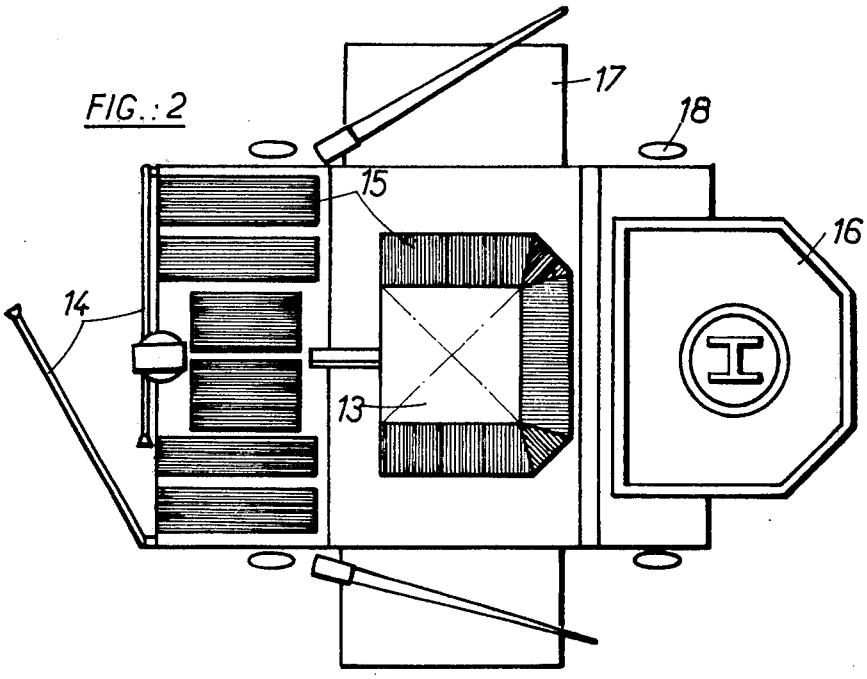
FIG. 2 is a plan view in the direction of the arrow II in FIG. 1.
Figure 3:
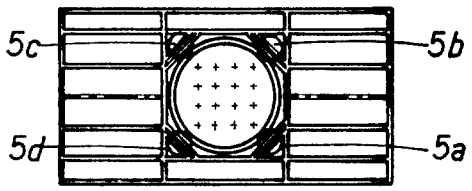
FIG. 3 is a diagrammatic view in horizontal section on a smaller scale, showing the devices for displacing the bridge.
Figure 7:
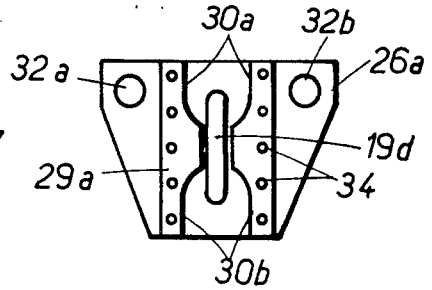
FIG. 7 is a section on the line VII—VII of FIG. 6.
Figure 6:
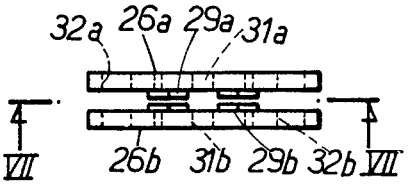
FIG. 6 is a section on a larger scale on the line VI—VI of FIG. 4.

The base 1 consists of a circular slab 1*a* which supports at its periphery a perforated wall 1*b* serving, when the slab rests on the bed 6 of the sea (FIG. 1), to protect the platform against erosions of the bed 6 by submarine currents, as described in the applicants' U.S. Pat. No. 3,878,684.

The hollow column 2, of impervious construction, is erected in the middle of the slab 1*a* and is rigidly connected thereto and to the wall 1*b* by a plurality of diaphragms or radial gussets 1*c*. At the top of the column 2 is fixed a metallic framework 2*a* the purpose of which will be indicated hereinafter.

The bridge 3 consists of a network of metallic girders 7 for supporting the assembly of devices and installations of the platform, and the shell 3*a* consists of an impervious case fixed to this network of metallic girders and comprising an exterior peripheral portion 8, an interior cylindrical portion 9 surrounding the column 2, and an annular base portion 10. The interior space of the bridge is divided by impervious partitions 11, fixed to the girders 7, into compartments 12 containing various devices and installations. On the bridge are located other installations such as a derrick 13, cranes 14, pipe racks 15, a helicopter landing stage 17 and davits (not shown) supporting ship's boats 18.

The lifting apparatus 5 comprises four identical devices 5a, 5b, 5c, 5d (FIG. 3) one of which is shown in detail in FIGS. 4 to 7. Each device comprises a chain 19 and four hydraulic jacks. The chain 19 passes between two box-girders 20, 20a of the bridge 3 (see FIG. 5); its lower end is fixed to the base 1 and its upper end to a bracket 19a, itself fixed to the metallic framework 2a (see FIG. 8b). The cylinders such as 21a, 21b of two of the four hydraulic jacks are fixed to a member 22, in the form of an A, fixed to the girder 20 by bolts 23a, 23b. The cylinders such as 21c of the other two jacks are fixed to a member 22a identical to the member 22 and fixed to the girder 20a by bolts not shown. The pistons of these jacks, such as 24a, 24b, 24c are fixed by rocking levers 25a, 25b to a chain-clamping 26. Another chain-clamping 27 is placed in the facing windows 28, 28a of the members 22, 22a.

The chain-clamping member 26 comprises (FIGS. 6 and 7) two plates 26a, 26b provided, facing each other, with two pairs of bosses 29a, 29b together forming two opposed seatings 30a, 30b for two adjacent parallel links 19b, 19c of the chain (FIG. 4), and with two openings 31a, 31b together forming a seating for the link 19d located between the links 19b and 19c. These two plates are traversed by holes 32a, 32b through which pass pivot pins 33a, 33b serving to fix the rocking levers 25a, 25b, and by other holes 34 through which pass bolts which clamp the plates against each other in order to imprison between them the links 19b, 19c, 19d of the chain 19. The chain-clamping member 27 comprises two plates 27a, 27b, similar to the plates 26a, 26b, but reinforced respectively by gussets 35a, 36a and such as 35b, which are fixed at top and bottom to flanges 37a, 37b, 38a, 38b and such as 39a, 39b, which can bear alternatively against the upper and lower edges of the windows 28, 28a as explained hereinafter.

FIGS. 8, 8a and 8b illustrate the construction and equipping on land of the platform in a pit made at the edge of the sea to form a dock. After dredging the ditch 40 to an adequate depth, a removable dike 41 is erected and the dock is drained by pumping. The construction of the base 1 and of the hollow column 2 is then carried out, and the placing in position of the framework 2a is begun (FIG. 8). When the construction of the concrete structure is finished, one proceeds, using members prefabricated on land, to mount the skeleton of the bridge 3 and the casing 3a around the hollow column, as well as to mount the lifting device 5 and to place in position the majority at least of the devices and installations of the platform (FIGS. 8a and 8b). In the embodiment shown, the derrick 13 is built up to only part of its height, shown as 13a in FIGS. 8b, 9, 10 and 11, in order to ensure the stability of the platform during its launching and towing.

The openings 42 in the wall 1b are then closed (FIG. 1) as described in the applicants' U.S. Pat. No. 3,914,947 and launching is carried out by filling the ditch 40 by pumping, and then the dike 41 is removed (FIG. 9). The platform is then supported on the water by the float consisting of the base 1 of which the openings 42 are closed, so that it is not necessary to dredge the ditch 40 very deeply. The floating construction is then towed out of the dock and water is introduced into the base 1 by pumping so that the assembly of the platform and the installations already placed in position is kept afloat by the shell 3a acting as a float (FIG. 10). The closures of the openings 42 are then removed. The platform is towed in this condition to its installation site.

It may be remarked that the hollow column 2, which is of impervious construction, also forms a float, but because of its relatively small section, contributes to only a small extent (10 to 11% approximately) to keeping the platform afloat.

Figure 4:
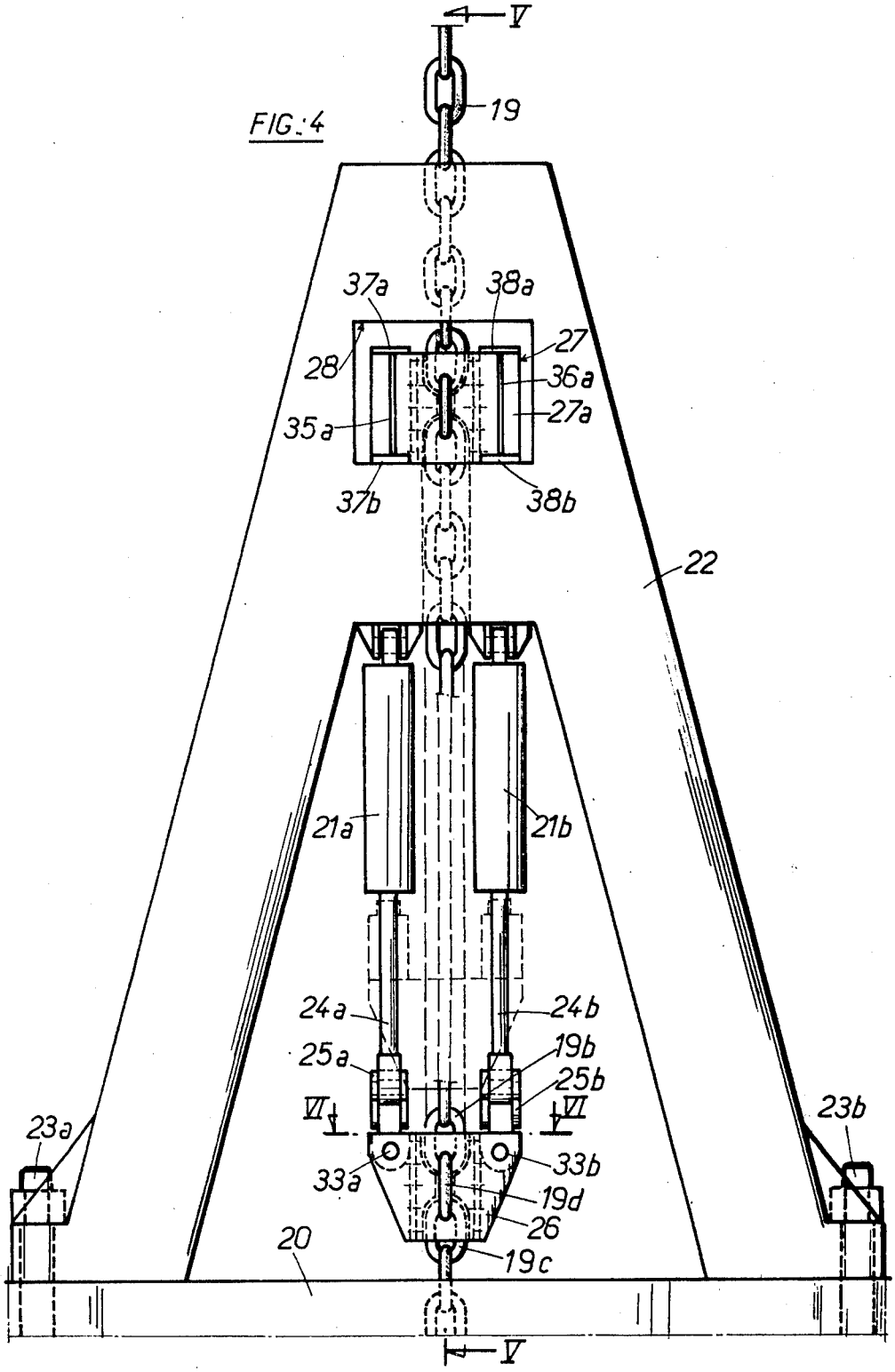
FIG. 4 is an elevation on a larger scale of one of the displacing devices.
Figure 5:
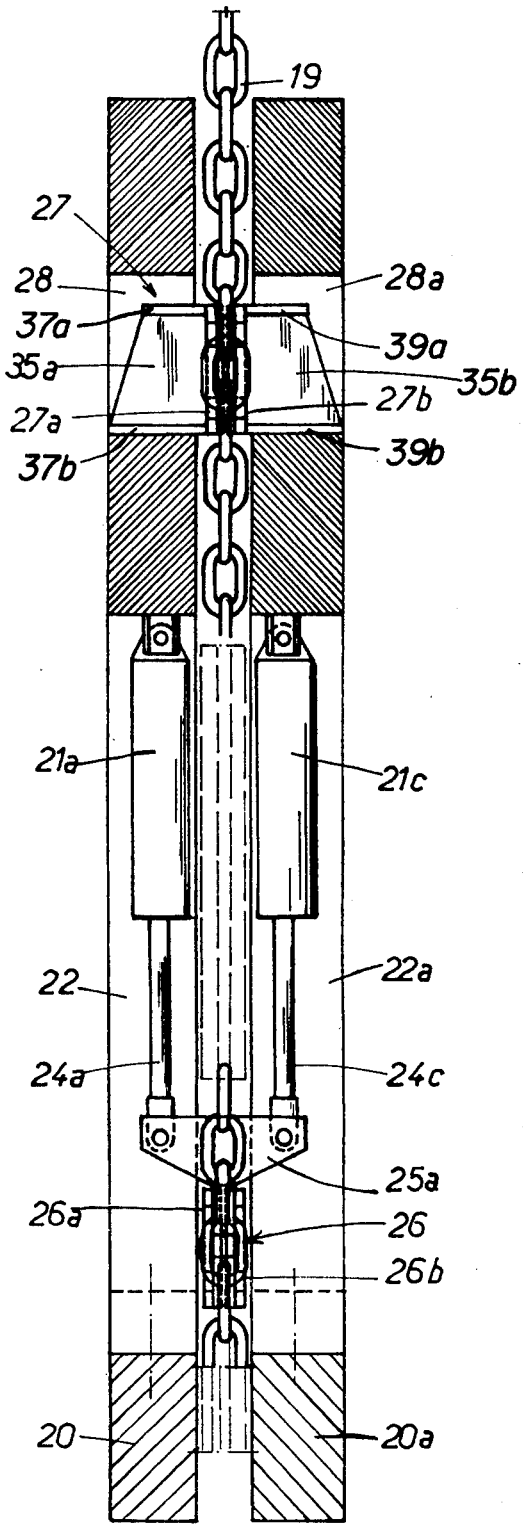
FIG. 5 is a section on the line V—V of FIG. 4.

While the platform is thus kept afloat by the shell 3a of the bridge 3, the weight of the platform and the installations is transmitted to the bridge by the chains 19. The lower portion of the latter (between the base 1 and the chain-clamping members) is thus under tension, and the lower flanges such as 37b, 38b and 39b of the members 27 rest on the lower edge of the windows 28, 28a as shown in FIGS. 4 and 5. At the installation site, the lifting devices are actuated for first controlling the descent of the base 1 to the bed 6 of the sea (FIG. 11), then for raising the bridge 3 along the hollow column 2 towards the framework 2a while the base 1a bears on the bed (FIG. 11a).

To this end, starting from the position shown in FIGS. 4 and 5, one loosens the bolts which clamp together the plates 26a, 26b of the chain-clamping devices of the four lifting devices 5a, 5b, 5c, 5d, one separates these plates to disengage the chains, and one simultaneously actuates the jacks of the four lifting devices in the direction of contraction (by means of a control and a supply of hydraulic fluid not shown) until the chain-clamping members occupy the position shown in broken lines in FIG. 4. One then replaces and tightens the bolts in order to imprison again the chains 19 between the plates 26a and 26b in this position. One then similarly disengages the chain-clamping members 27 of the chains 19, one actuates the jacks in the direction of extension, one again imprisons the chains 19 between the members 27, and so on.

From the moment when the base 1 rests on the bed 6 (FIG. 11a), it is the base 2 which supports the weight of the bridge 3 through the chains 19, so that it is the upper portion of the latter (between the chain-clamping members and the brackets 19a) which are under tension, and that the upper edge of the windows 28, 28a rest on the lower flanges such as 37a, 38a and 39a of the chain-clamping members 27.

One then fixes the bridge 3 to the framework 2a by means of bolts (not shown) or welding rods.

It goes without saying that the embodiment described is only an example and could be modified, particularly by the substitution of technical equivalents, without departing from the scope of the invention. In particular, the perforated wall 1b could be replaced by a solid anti-erosion wall as described in the applicants' U.S. Pat. No. 4,019,332 or connected at its upper end to a solid column 2 by a solid or perforated slab as described in the U.S. Pat. No. 3,914,947 already referred to. It would also not depart from the scope of the invention by providing three or more than four lifting devices.

One could also, without departing from the scope of the invention, support the platform by the float constituted by the base 1, not only during the launching of the platform but also while it is being towed to its installation site. One would also not depart from the scope of the invention by replacing the anti-erosion wall by a circular wall of a slightly smaller diameter than the slab, or even by a simple circular rib.

We claim:

1. A gravity platform for supporting installations above a body of water, comprising a base having a slab adapted to rest on the bed of the body of water, and a peripheral wall forming therewith a float having a buoyancy sufficient to support the assembly of the platform and the installations; a hollow column secured to the base and extending vertically therefrom; an annular bridge extending around the hollow column, having an impervious shell covering the underface and the inner and outer peripheral surfaces of the bridge to form a float having a buoyancy sufficient to support the assembly of the platform and the installations; and means for displacing the bridge along the hollow column.

2. A platform according to claim 1, in which the means for displacing the bridge along the hollow column comprise at least three lifting devices each comprising a chain fixed to the base and to the top of the hollow column, a first releasable chain-clamping device for connecting the chain releasably to the bridge, a system of jacks having a first end connected to the bridge and a second end, and a second releasable chain-clamping device for connecting the chain releasably to the second end; and means for simultaneously extending and retracting said systems of jacks.

3. A platform according to claim 1, in which the base and the hollow column form a massive concrete structure, while the bridge comprises a framework of metallic girders for supporting the installations, and the shell fixed to said girder framework.

4. A method of constructing a platform according to claim 1 comprising the steps of: carrying out in a dry dock the complete construction of the platform and the placing in position of the major part at least of the installations, filling the dock with water so that the platform is supported on the water by the base, towing the platform out of the dock, ballasting the base so that the platform is supported by the impervious shell floating on the water, towing the platform to the installation site, and displacing the bridge upwardly along the hollow column.

5. A gravity platform for supporting installations above a body of water, comprising a base having a slab adapted to rest on the bed of the body of water, and a peripheral wall forming therewith a float having a buoyancy sufficient to support the assembly of the platform and the installations; an impervious hollow column secured to the base and extending vertically therefrom; an annular bridge extending around the hollow column, having an impervious shell covering the underface and the inner and outer peripheral surfaces of the bridge to form a float, said float and said impervious hollow column together having a buoyancy sufficient to support the assembly of the platform and installations; and means for displacing the bridge along the hollow column.

6. A platform as claimed in claim 5, in which the means for displacing the bridge along the hollow column comprise at least three lifting devices each comprising a chain fixed to the base and to the top of the hollow column, a first releasable chain-clamping device for connecting the chain releasably to the bridge, a system of jacks having a first end connected to the bridge and a second end, and a second releasable chain-clamping device for connecting the chain releasably to the second end; and means for simultaneously extending and retracting said system of jacks.

7. A platform according to claim 5, in which the base and the hollow column form a massive concrete structure, while the bridge comprises a framework of metallic girders for supporting the installations, and the shell fixed to the girder framework.

8. A method of constructing a platform according to claim 5, comprising the steps of: carrying out in a dry dock the complete construction of the platform and the placing in position of the major part at least of the installations, filling the dock with water so that the platform is supported on the water by the base, towing the platform out of the dock, ballasting the base so that the platform is supported by the impervious shell of the bridge, floating on the water, towing the platform to the installation site, and displacing the bridge upwardly along the hollow column.

* * * * *